US005361939A

United States Patent [19]

Robertson, Jr.

[11] Patent Number: 5,361,939

[45] Date of Patent: Nov. 8, 1994

[54] ROLLED TUBE RETAINER

[76] Inventor: James A. Robertson, Jr., 3108 S. Kiwanis Ave., Sioux Falls, S. Dak. 57105-4207

[21] Appl. No.: 172,229

[22] Filed: Dec. 22, 1993

[51] Int. Cl.[5] ..... B65D 35/00; B65D 37/00

[52] U.S. Cl. ..... 222/1; 222/92; 132/248

[58] Field of Search ..... 222/99–103, 222/92, 107, 1; 132/40, 42 R, 41

[56] References Cited

U.S. PATENT DOCUMENTS

| | | | |
|---|---|---|---|
| 537,928 | 4/1895 | Klaber | 222/99 |
| 1,987,428 | 1/1935 | Whiteman | 222/99 |
| 2,097,308 | 10/1937 | Ruth . | |
| 2,183,060 | 12/1939 | Blake . | |
| 2,341,601 | 2/1944 | De Kadt | 222/99 X |
| 2,645,233 | 7/1953 | Bein . | |
| 2,656,065 | 10/1953 | Breeze . | |
| 3,628,696 | 12/1971 | Ouiker . | |
| 3,759,421 | 9/1973 | Hausmann . | |
| 4,513,760 | 4/1985 | Tihonovich . | |
| 4,653,670 | 3/1987 | Kendrick | 222/99 |
| 5,014,879 | 5/1991 | Hill . | |
| 5,082,144 | 1/1992 | Sundstrom . | |
| 5,108,008 | 4/1992 | Ryder . | |
| 5,178,301 | 1/1993 | McGanty . | |
| 5,205,438 | 4/1993 | Southard . | |

FOREIGN PATENT DOCUMENTS

| | | | |
|---|---|---|---|
| 537069 | 2/1957 | Canada . | |
| 240275 | 10/1925 | United Kingdom | 222/99 |
| 415249 | 8/1934 | United Kingdom . | |
| 603748 | 6/1948 | United Kingdom . | |

*Primary Examiner*—Andres Kashnikow
*Assistant Examiner*—Kenneth DeRosa
*Attorney, Agent, or Firm*—Richard C. Litman

[57] ABSTRACT

The present invention is a retaining device for maintaining a collapsible tube in a rolled condition. This retaining device is for placement over the rolled portion of a flexible tube and is made from flexible material which molds to the shape of the tube bottom. The shape of the retaining device is such that it does not interfere with the storage or use of the collapsible tube. A gripping tab may be provided to aid in both the removal of the device from the tube and the placement of the device on the tube.

13 Claims, 2 Drawing Sheets

ROLLED TUBE RETAINER

BACKGROUND OF THE INVENTION

1. FIELD OF THE INVENTION

The present invention relates to a retainer for a collapsible dispensing tube. More particularly, the invention discloses a retainer of flexible and expandable material for attachment to the rolled portion of a collapsible dispensing tube to maintain the tube in a rolled configuration.

2. DESCRIPTION OF THE PRIOR ART

Collapsible dispensing tubes for semi-liquid and gel-like substances are well known in the prior art and are used for dispensing substances ranging from toothpaste to adhesives. The walls of these tubes are of sufficient strength to avoid rupture and are of sufficient flexibility to be collapsible and deformable. Pressing the walls of these tubes together forces substance from the open end of the tube. As the substance inside a portion of the tube becomes exhausted, the end portion of the walls of the tube may be rolled upon itself to assure maximum dispensing. As increased dispensing is desired, the amount of the tube that is rolled may be increased.

The strong but flexible material of these tubes does not independently maintain its rolled or wound configuration. Therefore, before using a tube which has previously been rolled, the end portion of the tube must be re-rolled to its previous configuration. To avoid this burdensome and time consuming rerolling, many inventions have disclosed devices to prevent the unrolling of the end portion of a tube.

One such device is disclosed in U.S. Pat. No. 3,759,421 issued to Hausmann on Sep. 18, 1973. This retaining device is an omega-shaped elastic strip of plastic or metal to fit over the rolled portion of a tube. It attaches to the sides of a dispensing tube and the base of the device blocks the rolled portion of the tube from unravelling.

Retaining devices have also been used in conjunction with rolling keys or other apparatuses used to aid in the rolling of the end of the tube. Often, these retaining devices are affixed to the rolling apparatus and positioned to block the unwinding of the rolled portion of the tube. One example of this type of retaining device is seen in U.S. Pat. No. 5,082,144 issued to Sundstrom on Jan. 21, 1992. This invention discloses a retaining clip having a slot for receiving the sealed end of the tube. The tube is wound around the retaining clip and a loop extending from the end of the clip prevents the wound portion of the tube from unraveling.

Other retaining devices used in conjunction with rolling keys or other rolling apparatuses can be seen in U.S. Pat. No. 3,628,696 issued to Duiker on Dec. 21, 1971 (a winding mandrel having a throw to exert pressure on the rolled portion of a tube to prevent it from unwinding), U.S. Pat. No. 5,014,879 issued to Hill on May 14, 1991 (a tube roller with a pivoting end for securing the rolled portion), U.S. Pat. No 5,108,008 issued to Ryder on Apr. 28, 1992 (a tube end tie having a first portion for winding the tube and a second portion to acts as a shackle to retain the tube in a rolled condition), U.S. Pat. No. 5,178,301 issued to McGanty on Jan. 12, 1993 (a rolling device having a slotted handle for receiving and securing the wound portion of a tube), U.S. Pat. No. 5,205,438 issued to Southard on Apr. 27, 1993 (a rolling device having a loop connecting the ends of the device for placement over the rolled portion of a tube), Great Britain Pat. No. 603,748 issued to Middelkoop on Jun. 22, 1948 (a container having a flattened end for rolling and a device for piercing the walls of the tube to secure the rolled portion).

Also disclosed in the prior art are retaining devices attached to tube holders. Examples of these type of retainers can be seen in U.S. Pat. No. 2,097,308 issued to Ruth on Oct. 26, 1937 and U.S. Pat No. 2,183,060 issued to Blake on Dec. 12, 1939. These patents disclose housings for collapsible tubes wherein the collapsible tube is secured between brackets or guide members. Rotatable shafts, securable about the brackets or guide members, aid in rolling the closed end of the tube and also prevent unwinding.

The use of retainers has also been present in the hair curling industry. After hair has been wound onto curlers, retaining devices prevent the hair from unwinding from the curler. Patents showing the use of retainers in conjunction with hair curlers are U.S. Pat. No. 2,645,233 issued to Bein on Jul. 14, 1953 and U.S. Pat. No. 4,513,760 issued to Tihonovich on Apr. 30, 1985. The Bein patent discloses a substantially rectangular retainer made from a resilient and stretchable material. Two triangular openings permit the retainer to engage seats positioned on opposite ends of the curler and a bridge portion between the openings prevents the hair from leaving the curler. The Tihonovich patent shows a retainer having two ring ends connected by a band. The ring ends fit over the ends of the cutler to engage a boss. This secures the 25 retainer to the curler and the band of the retainer prevents the cutler from winding away from the scalp.

None of the above inventions and patents, taken either singly or in combination, is seen to describe the instant invention as claimed.

SUMMARY OF THE INVENTION

The present invention is an easily manufactured, inexpensive retaining device for maintaining a collapsible tube in a rolled condition. This retaining device is formed from an elongated piece of flexible and expandable material having a uniform thickness and a circular aperture at both of its ends. The retaining device is stretched until each aperture receives one corner of the rolled portion of a collapsible tube. With each corner of the rolled portion inside an aperture, the retaining device molds to the shape of the tube bottom to prevent the rolled portion from unraveling. A gripping tab may be provided at one end of the device to aid in both the removal of the device from the tube and the placement of the device on the tube.

Accordingly, it is a principal object of the invention to provide a novel retaining device for securing a rolled portion of a collapsible dispensing tube.

It is another object of the invention to provide a novel retaining device that will not interfere with the storage or use of a collapsible dispensing tube.

It is a further object of the invention to provide a novel retaining device of a single piece of material and an uncomplicated design.

Still another object of the invention is to provide a novel retaining device which may be easily attached to or removed from a rolled portion of a collapsible dispensing tube.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
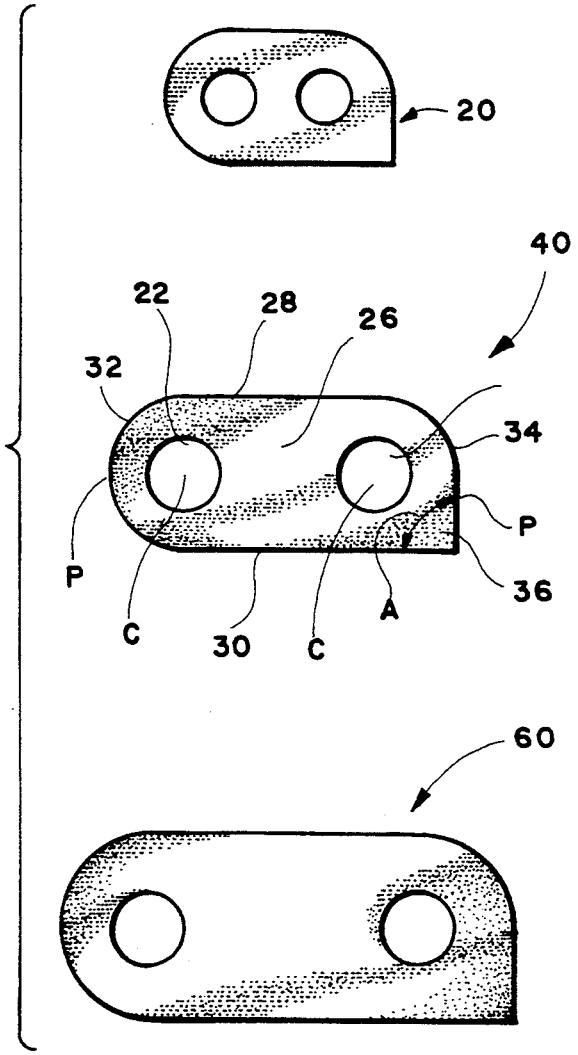
FIG. 1 is a top plan view showing three collapsible tube retainers each having arcuate ends and a gripping tab.
Figure 2:
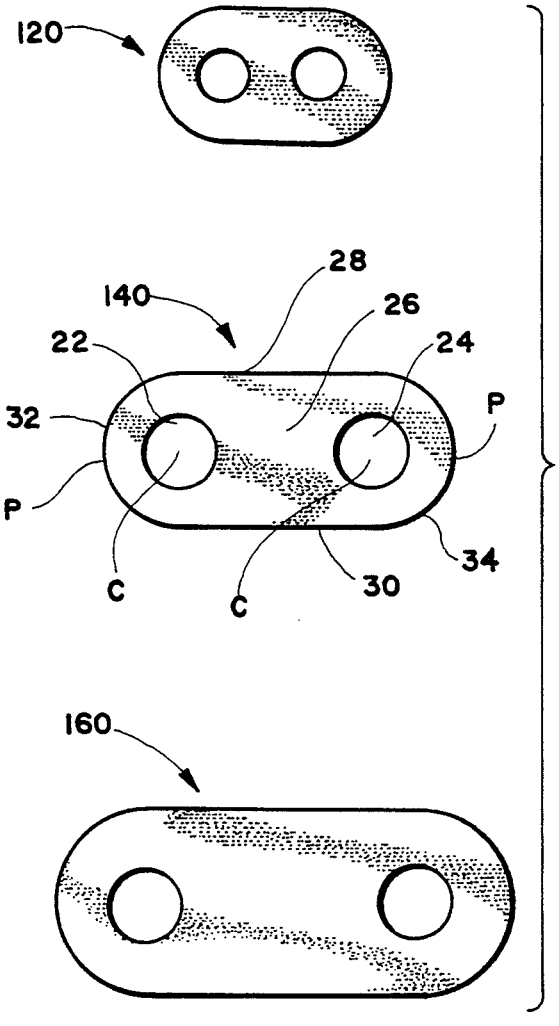
FIG. 2 is a top plan view showing three collapsible tube retainers each having arcuate ends and no gripping tab.

The present invention is a re-usable retaining device for maintaining a collapsible tube in a rolled condition. FIG. 1 shows three varying sizes, 20, 40, and 60 of the retaining device. FIG. 2 shows three varying sizes 120, 140, and 160 of an alternate configuration of the retaining device. For illustration purposes, device 40 will be used throughout this discussion to represent all configurations of the device. When necessary, the specifics of the individual retaining devices of FIGS. 1 and 2 will be discussed in detail.

Retaining device 40 is a single elongated body having two circular apertures 22, 24 spaced apart to define a bridge portion 26. The perimeter of the retaining device 40 includes two straight sides 28 and 30 and two arcuate ends 32 and 34. Positioned at the junction of one of the straight sides, 28 or 30, and one of the arcuate ends, 32 or 34, is a gripping tab 36 defining a corner element of an angle A of approximately 90 degrees. The alternative configuration shown in FIG. 2 does not have the gripping tab 36.

Figure 3A:
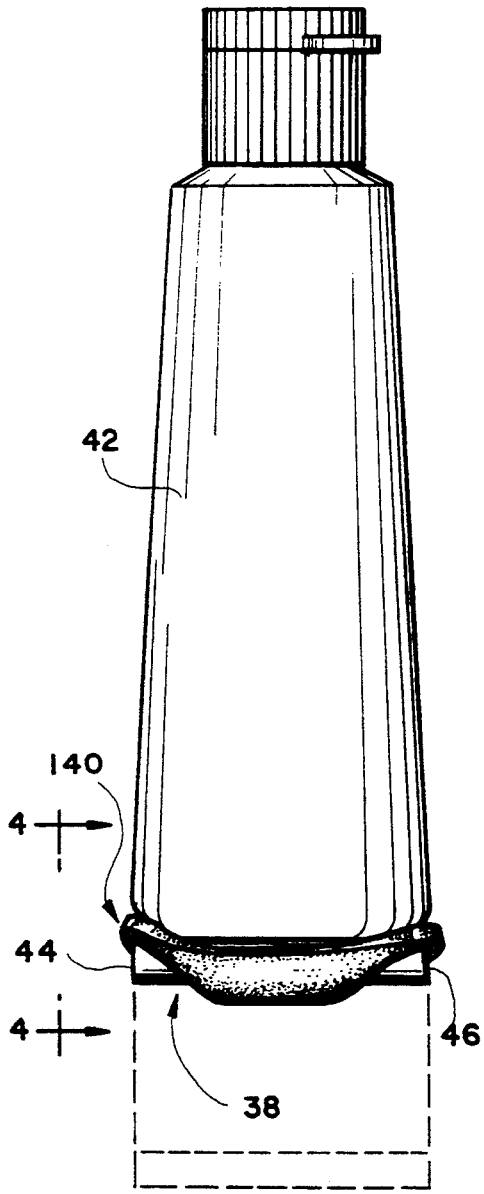
FIG. 3A is a front elevational view of a collapsible tube retainer secured to the rolled portion of the collapsible dispensing tube.
Figure 4:
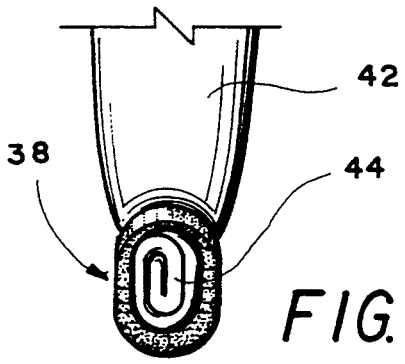
FIG. 4 is an enlarged partial side view taken along line 4—4 of FIG. 3A.

As shown in FIGS. 3A and 4, the retaining device 40 is attachable to the rolled portion 38 of a collapsible tube 42 to block it from unravelling. One of the circular apertures 22 or 24 is positioned around one of the corners 44 or 46 of the rolled portion 38. Retaining device 40 is then stretched or expanded to place the loose circular aperture 22 or 24 around the uncovered corner 44 or 46 of the rolled portion 38. Rebound forces from the expanded retaining device 40 are exerted upon the corners 44 and 46 of the rolled portion 38 to secure the retaining device 40 on the rolled portion 38. The dotted lines in FIG. 3A represent the tube 42 in its unrolled condition.

In addition to being expandable, the material of the retaining device 40 is sufficiently flexible to mold to the shape of the rolled portion 38. This guarantees that the retaining device 40 does not interfere with the storage or use of the dispensing tube 42. Although rubber has proved to have sufficient flexibility and expandability for the present invention, any other material possessing these characteristics would suffice.

Although the shape of the apertures 22 and 24 is not limited to a circle, many factors weigh in favor of choosing such a shape for preferred embodiment of the invention. First, the rolled portion 38 has a generally circular shape which fits securely inside the circular aperture 22 and 24. The material of the retaining device 40 forming the circular apertures 22 and 24 contacts the entire perimeter of the rolled portion 38 to maintain the rolled portion 38 in a round configuration. If the apertures were of a non-circular shape, the rolled portion 38 could loosen or unwind. Second, the circular shape of the apertures 22 and 24 guarantees a considerable cross-section of material at the bridge portion 26. This is understood by comparing the bridge portion 26 formed between two circular apertures 22 and 24 to the bridge portion formed between non-circular apertures of a size comparable to the circular apertures 22 and 24. If the apertures were, for example, triangular with one of the points of the triangle facing toward the center of the retaining device, the bridge portion would have less material than if it were formed between two circular apertures. The maximum amount of material at the bridge portion 26 permits this portion 26 to withstand the tensile stresses arising when the retaining device 40 is in its blocking position. Finally, circular apertures 22 and 24 are easily manufactured thus minimizing both manufacturing and consumer costs.

The removal of the device 40 from the collapsible tube 42 is quick and easy. As mentioned previously, the gripping tab 36 is a corner element formed at a junction of one of the straight sides, 28 or 30, and one of the arcuate ends, 32 or 34. This gripping tab 36 extends from the elongated body and therefore does not mold to the shape of the collapsible tube 42 as firmly as the rest of the retaining device 40. Correspondingly, the gripping tab 36 may be easily separated from the tube 42 and pulled to remove the retaining device 40.

The gripping tab 36 is formed at one location on the retaining device 40 to prevent unnecessary waste of material. Additionally, having only one gripping tab 36 limits the locations where the retaining device 40 is not firmly molded to the rolled portion 38 to minimize potential interfere with the storage or use of the collapsible tube 42.

Figure 3C:
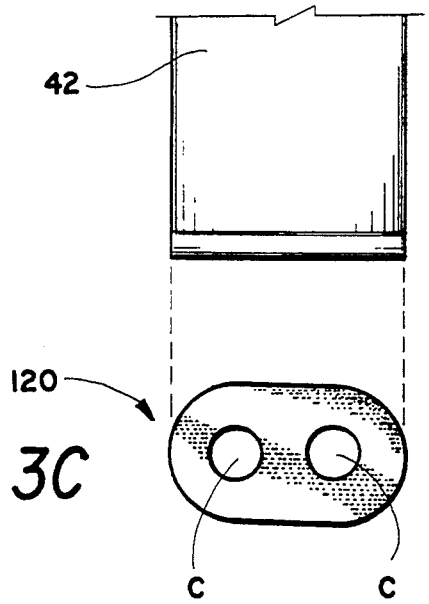
FIG. 3C shows an enlarged view of the size relationship between a tube and a retaining device not having a gripping tab.
Figure 3B:
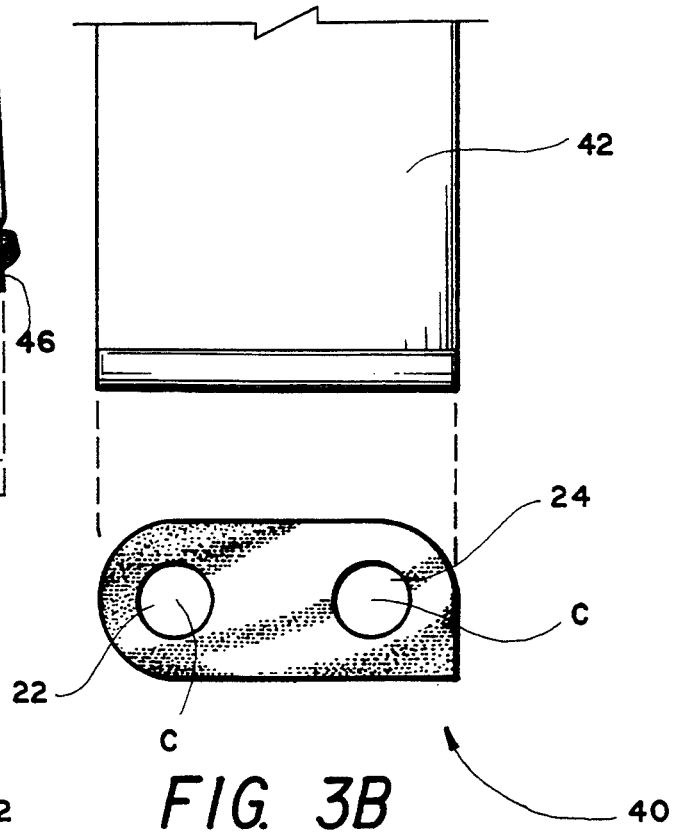
FIG. 3B shows an enlarged view of the size relationship between a tube and a retaining device having a gripping tab.

The retaining device 40 works most effectively when its overall length, L, is approximately equal to the width, W, of the bottom of the tube 42 to be retained. This size relationship of the retaining device 40 to the tube 42 assures that when the retaining device 40 is stretched for affixing on the tube 42, there are sufficient rebound forces to hold the device 40 on the tube 42 without creating forces of such strength to tear the retaining device 40. FIGS. 3B and 3C each show the desired size relationship of a retaining device, 40 and 120 respectively, to collapsible tubes. FIG. **3*b* depicts a retaining device 40 having a gripping tab 36 while FIG. 3*c* depicts a retaining device 120 without the gripping tab 36**.

A second advantage from having the length of the retaining device 40 equal to the width, W, of the bottom of the tube 42 arises if the retaining device 40 is marketed in the same package as a collapsible tube 42. Usually, the height, H, of the tube 42 is greater than the width, W, of the bottom of the tube 42. In these cases, the length, L, of the retaining device 40 is less than the height, H, of the tube 42. Therefore, including the retaining device 40 in the packaging of the tube 42 is accomplished with little or no modification of the existing packaging for the tube 42. The result is reduced manufacturing and consumer costs.

The retaining device 40 of the present invention could also be marketed independently of the tubes 42. Although it is ideal to have the length, L, of the retaining device 40 equal to the width, W, of the tube 42, consumers are best served if the retaining devices are manufactured in a limited number of standard sizes to fit the immense variety of shapes and configurations of tubes on the market. Although the present invention is not limited to these sizes, they are detailed below. For convenience purposes, the alternate configurations of FIG. 1 and 2 are discussed together.

The smallest retaining device 20, 120 is for tubes such as those commonly used for medical creams and ointments. This retaining device has an overall length, L, of 1.5 inches, a height, B, of $\frac{7}{8}$ of an inch and a thickness of approximately 1/16 of an inch. The arcuate ends 32 and 34 are formed from a $\frac{7}{8}$ of an inch diameter, and the circular apertures 22 and 24 are $\frac{3}{8}$ of an inch in diameter. The center, C, of these apertures are each midway between the straight sides 28 and 30 and are each 7/16 of an inch from point, P, on the arcuate ends 32 and 34. Point, P, is located midway between the straight sides 28 and 30.

A second retaining device 40, 140 is for most toothpaste and shampoo dispensing tubes as well as other tubes of a similar size. This retaining device, 40 or 140, has an overall length, L, of 2.25 inches, a height, B, of 1 inch and a thickness of approximately 1/16 of an inch. The arcuate ends 32 and 34 are formed from a 1 inch diameter, and the circular apertures 22 and 24 are $\frac{1}{2}$ of an inch in diameter. The center, C, of these apertures 22 and 24 are each midway between the straight sides 28 and 30 and are each $\frac{1}{2}$ of an inch from point, P, on the arcuate ends 32 and 34. Point, P, is located midway between the straight sides 28 and 30. Finally, there is a retaining device 60, 160 for extremely large tubes. Examples of these tubes are those found in dispensing greases and other automotive substances. This retaining device 60, 160 has an overall length, L, of 3 inches, a height, B, of 1.25 inches and a thickness of approximately 1/16 of an inch. The arcuate ends 32 and 34 are formed from a 1.25 inch diameter, and the circular apertures 22 and 24 are $\frac{1}{2}$ of an inch in diameter. The center, C, of these apertures 22 and 24 are each midway between the straight sides 28 and 30 and are each $\frac{5}{8}$ of an inch from point, P, on the arcuate ends 32 and 34. Point, P, is located midway between the straight sides 28 and 30.

It is to be understood that the present invention is not limited to the sole embodiment described above, but encompasses any and all embodiments within the scope of the following claims.

I claim:

1. A retaining device for use with opposite corners of a rolled portion of a collapsible tube comprising:

an elongated body of flexible and expandable material having predetermined length, height and thickness, said elongated body defining first and second tube corner engagement members engaging the opposite corners of the rolled portion of the collapsible tube, when said device is in use, said elongated body further defining a bridge portion located between said tube corner engagement members, said bridge portion extending substantially the height of said elongated body.

2. The retaining device according to claim 1 wherein said elongated body further comprises first and second ends, each of said first and second ends having at least one arcuate portion.

3. The retaining device according to claim 1 wherein said elongated body further includes a first end having at least one arcuate portion and a second end having at least one arcuate portion and a gripping tab.

4. The retaining device according to claim 1, wherein each of said tube corner engagement members is configured as a circular aperture.

5. The retaining device according to claim 1 wherein said thickness of said elongated body is substantially uniform.

6. The retaining device according to claim 3 wherein said gripping tab comprises a corner element at one of said first and second ends of said elongated body, said corner element defining an angle of approximately 90 degrees.

7. A retaining device for use with opposite corners of a rolled portion of a collapsible tube comprising:

an elongated body of flexible material having predetermined length, height and thickness, said elongated body defining first and second tube corner engagement members engaging opposite corners of the rolled portion of the collapsible tube, when said device is in use, said tube corner engagement members including two apertures, said elongated body further defining a bridge portion located between said two apertures, a first end having at least one arcuate portion, a second end having at least one arcuate portion and a gripping tab.

8. The retaining device according to claim 7 wherein each of said two apertures is configured as a circle.

9. The retaining device according to claim 7 wherein said thickness of said elongated body is substantially uniform.

10. The retaining device according to claim 7 wherein said gripping tab comprises a corner element at one of said first and second ends of said elongated body, said corner element defining an angle of approximately 90 degrees.

11. A method of using a collapsible tube retainer, comprising the steps of:

surrounding a first corner of the rolled portion of the collapsible tube with the collapsible tube retainer; and surrounding a second corner of the rolled portion of the collapsible tube with the collapsible tube retainer, whereby the collapsible tube retainer is affixed to the rolled portion of the collapsible tube and prevents the rolled portion of the collapsible tube from unraveling.

12. A method of using a collapsible tube retainer according to claim 11, further comprising the step of:

contacting the sides of the rolled portion of the collapsible tube with a bridging element of the collapsible tube retainer.

13. A method of using a collapsible tube retainer according to claim 11, further comprising the step of:

pulling a gripping tab of the collapsible tube retainer to remove the collapsible tube retainer from the collapsible tube.

* * * * *